US005954196A

United States Patent [19]

Lin

[11] Patent Number: 5,954,196

[45] Date of Patent: Sep. 21, 1999

[54] SUSPENDABLE VACUUM STORAGE BAG

[76] Inventor: Hong-Long Lin, P.O. Box 82-144, Taipei, Taiwan

[21] Appl. No.: 09/157,501

[22] Filed: Sep. 21, 1998

[51] Int. Cl.[6] ..... B65D 85/18

[52] U.S. Cl. ..... 206/286; 206/289; 206/524.8; 206/806; 383/22

[58] Field of Search ..... 206/278, 284, 206/286, 287, 287.1, 288, 289, 524.8, 806; 383/22, 23, 24, 100

[56] References Cited

U.S. PATENT DOCUMENTS 5,090,559 2/1992 Gendreau ..... 206/284 X 5,480,030 1/1996 Sweeney et al. ..... 206/524.8

*Primary Examiner*—Jacob K. Ackun

*Attorney, Agent, or Firm*—A & J

[57] ABSTRACT

A suspendable vacuum storage bag includes a bag body and a suspending device. The bag body has a single opening forming a sealable opening. The suspending device is provided at an end opposite or adjacent to the sealable opening. The sealable opening can be sealed by sealing means after articles are placed flatly inside the bag body. Hangers on which articles are hung can be fastened to a suspending plate of the suspending device to achieve optimum use of available storage space. The bag body can be suspended by means of the suspending device.

8 Claims, 12 Drawing Sheets

SUSPENDABLE VACUUM STORAGE BAG

BACKGROUND OF THE INVENTION

1. Field of the Invention

The present invention relates to a suspendable vacuum storage bag, more particularly to a suspendable vacuum storage bag that makes optimum use of available storage space.

2. Description of the Prior Art

Conventional suspendable vacuum storage bags generally comprise a bag body and a suspending element provided on at least one side of the bag body. The suspending element includes a coupling portion fixedly connected to the bag body, an inner suspending portion extending inwardly from the coupling portion into the interior of the bag body and an outer suspending portion extending outwardly from the coupling portion, at least one first through hole on the inner and outer suspending portions, and a second through hole on an axis different from that of the first through hole for receiving connecting elements and a clothes hanger. However, such storage bags can only hold articles on a single hanger, which is not efficient in terms of use of storage space.

SUMMARY OF THE INVENTION

The present invention relates to a suspendable vacuum storage bag, more particularly to a suspendable vacuum storage bag that makes optimum use of available storage space.

A primary object of the present invention is to provide a suspendable vacuum storage bag that includes a suspending device having a suspending plate on which several articles of clothing may be hung, thereby achieving optimum use of available storage space. The suspending device may include suspending elements or hanging hooks depending on the environment in which the present invention is used.

Another object of the present invention is to provide a suspendable vacuum storage bag in which the suspending device is adapted for use with a vacuum storage bag that has a suction device and can be sealed by sealing means such as fitting rods, hot press lines, or male and female engaging means.

A further object of the present invention is to provide a suspendable vacuum storage bag in which the suspending device is adapted for use with a bag body provided with an S-shaped air channel.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
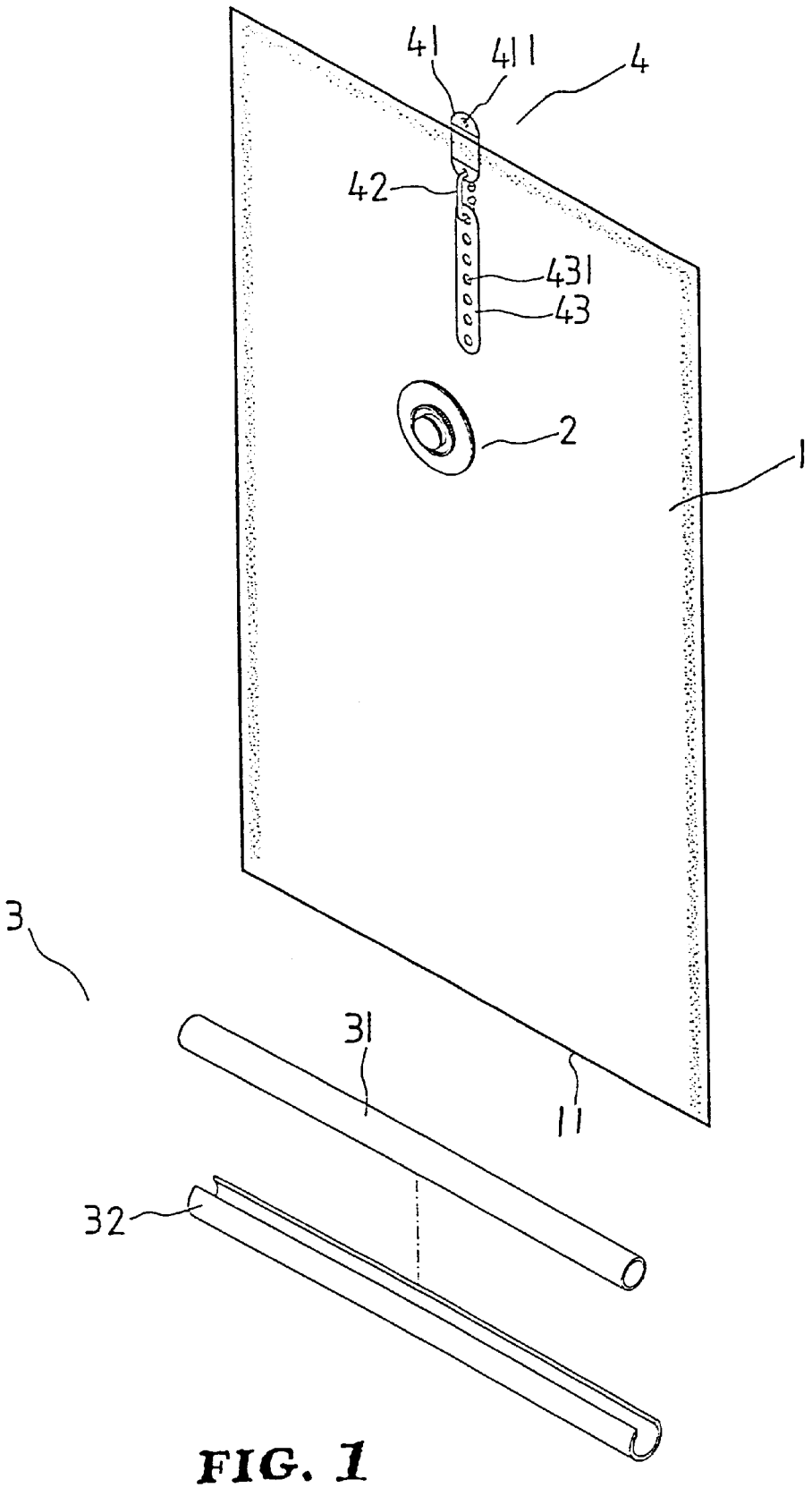
FIG. 1 is a schematic partly exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

A suspendable vacuum storage bag according to the present invention comprises a storage bag body 1 having a single opening and a sealable opening 11 at the single opening, and a suspending device 4 provided at an end opposite to the sealable opening 11 or adjacent thereto. After articles 5 are flatly placed into the storage bag body 1 via the sealable opening 11, the sealable opening 11 is sealed by using rod fitting means 3 or hot press lines 6 or male and female engaging means 7, and suspending hook portions of the articles 5 may be suspended on a suspending plate 43 adapted to hold several hook portions to achieve optimum use of available storage space. The suspending device 4 may be suspended by means of a suspending element 41 or a hanging hook 44 depending on the environment in which it is used.

Figure 2:
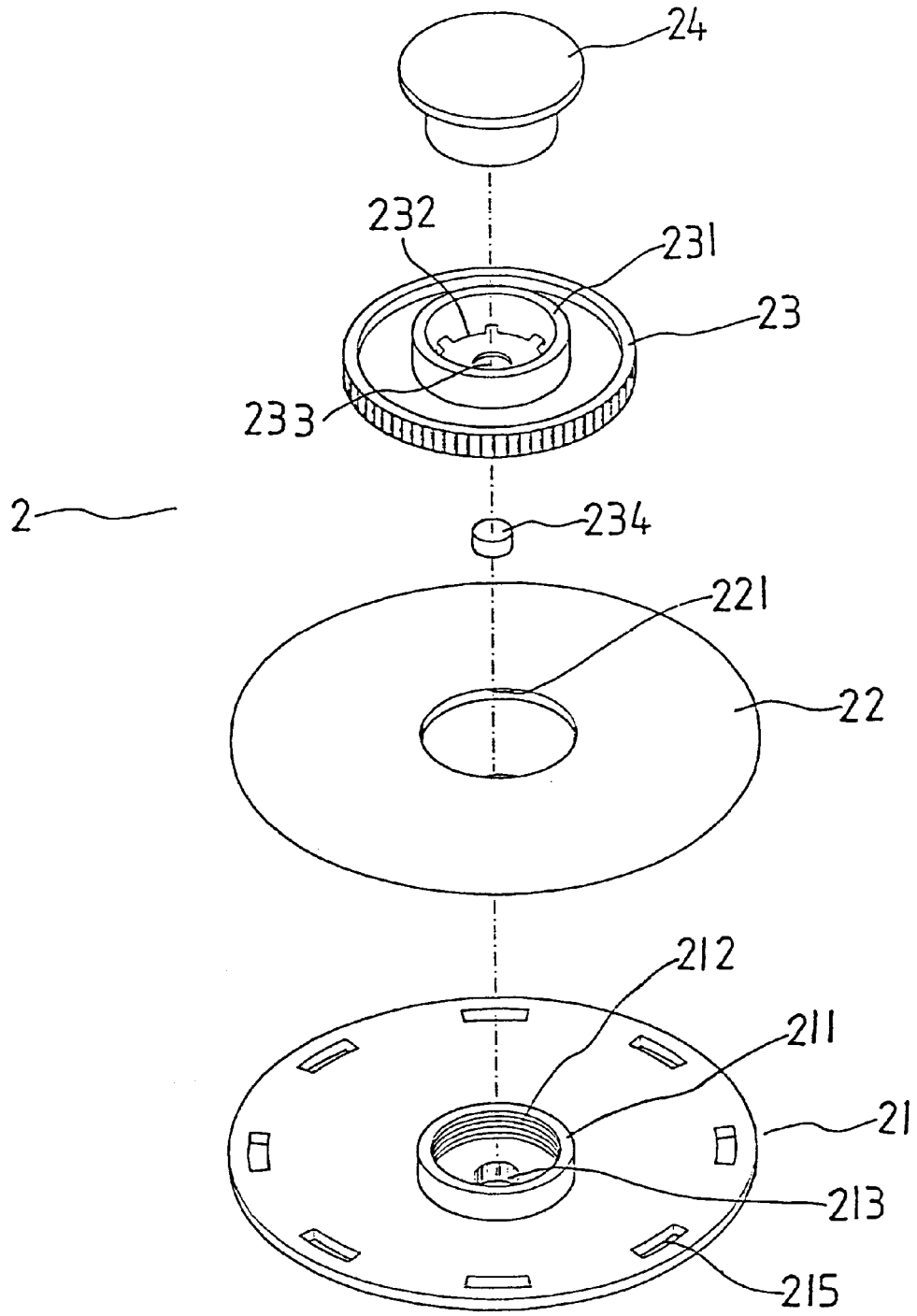
FIG. 2 is an exploded view of an air suction device of the present invention.
Figure 2A:
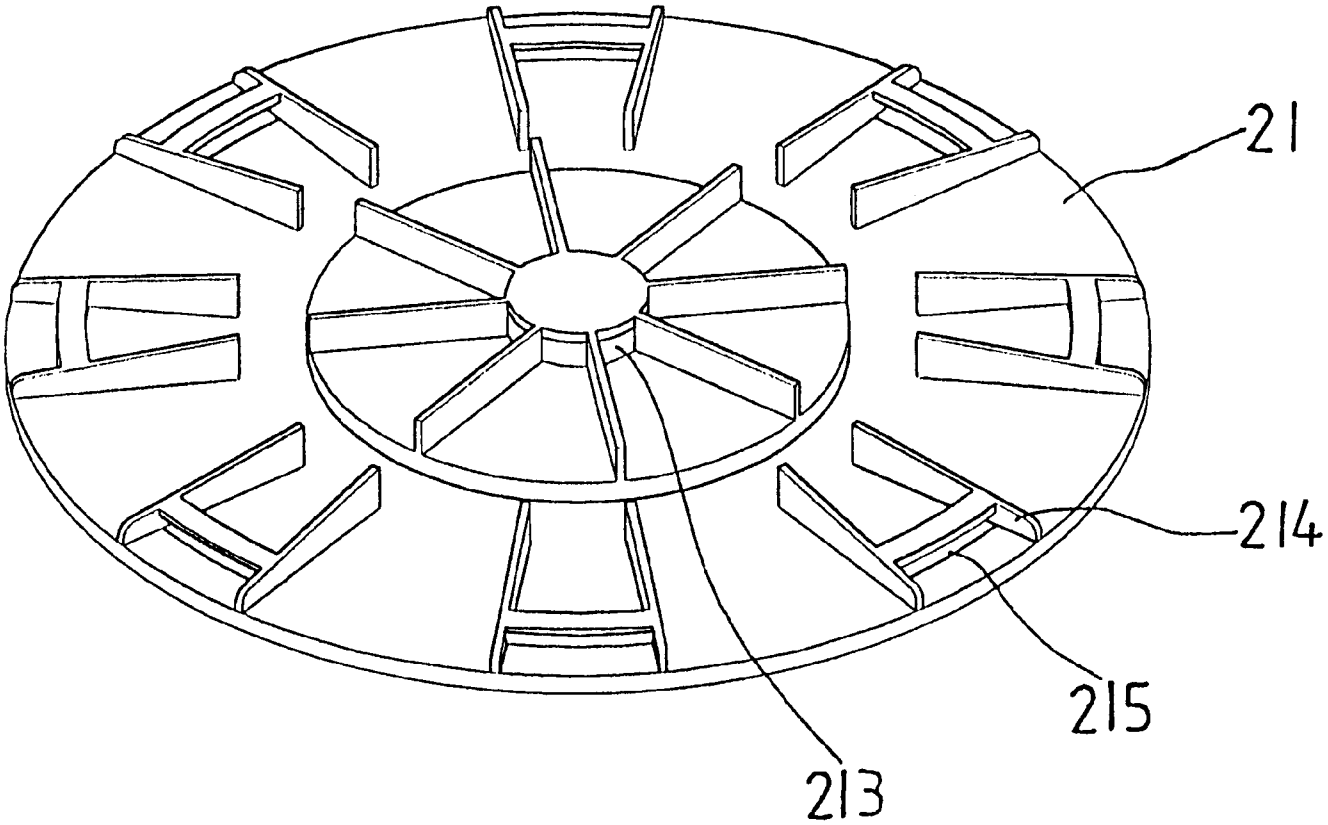
FIG. 2(A) is a schematic view of a seat of the air suction device of the present invention.
Figure 5B:
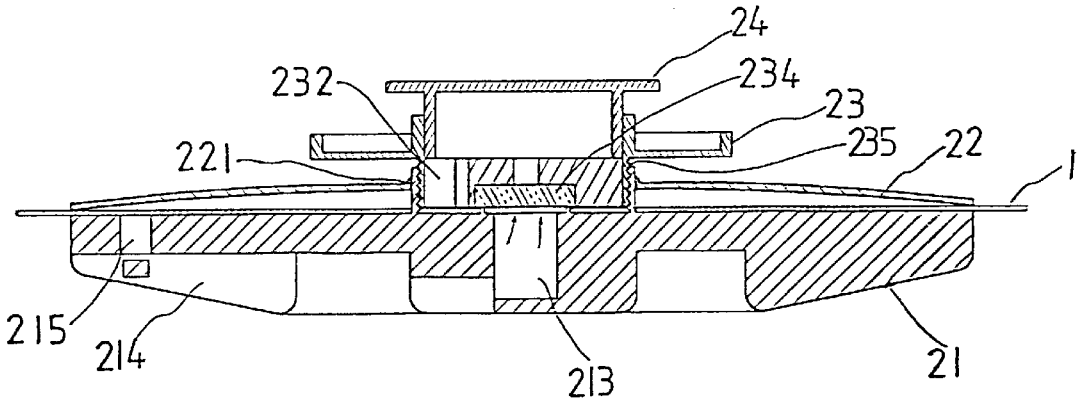
FIG. 5(B) is a schematic view showing closure of the bag body by a cover after the bag body has been made vacuum.
Figure 3:
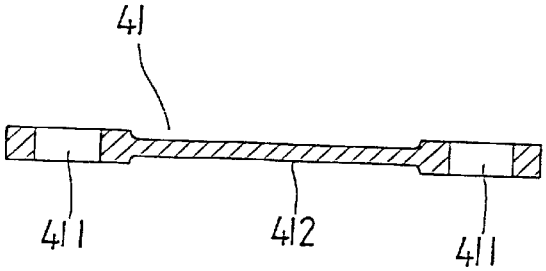
FIG. 3 is a sectional view taken along line A—A of FIG. 1.
Figure 5A:
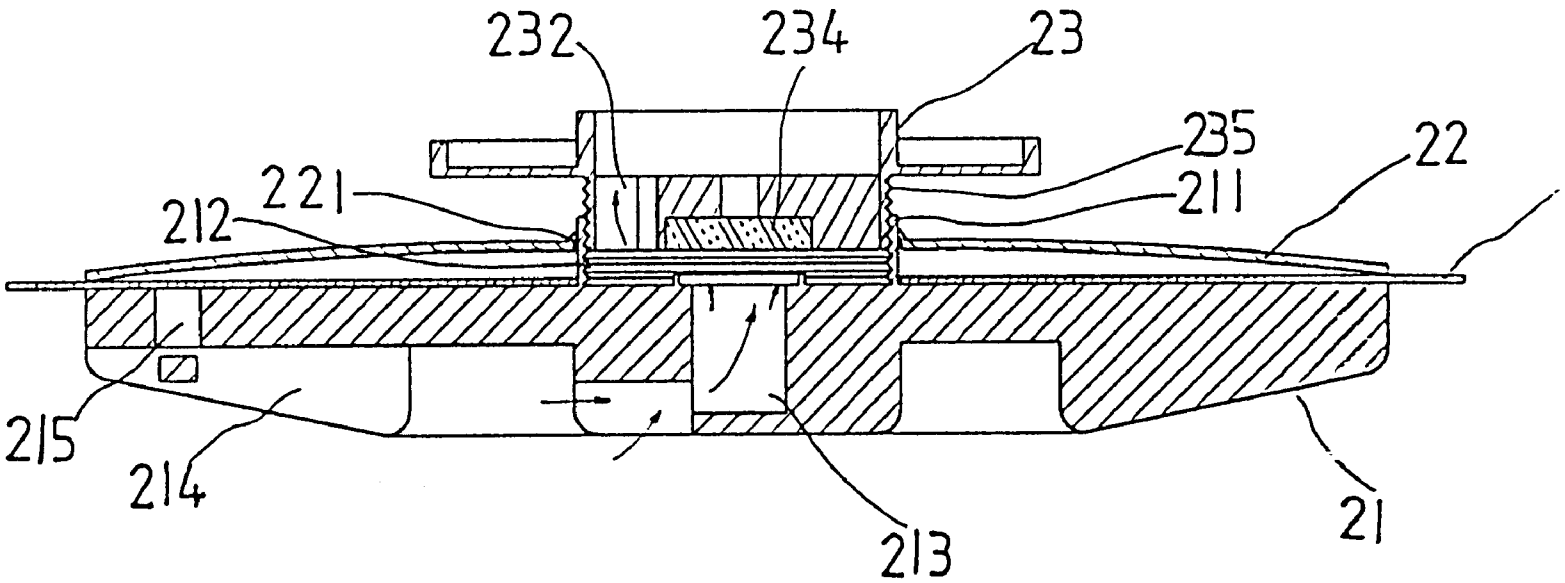
FIG. 5(A) is a schematic view showing operation of the air suction device in which air inside the bag body is extracted.

Referring to FIG. 1, the sealable opening 11 of the storage bag body 11 is sealed by using rod fitting means 3. The discharge of air is by utilizing a suction device 2. In the present invention, the suspending device 4 utilizes a suspending element 41 having a thin plate 412 with thickness-enlarged portions on both sides thereof to couple firmly to the sealed opening of the storage bag body 1. The thickness-enlarged portions of the suspending element 41 are each provided with a through hole 411 (as shown in FIG. 3). The through hole 411 on the outer rim of the storage bag body 1 is provided to fasten to a hanging hook 81 of a clothes hanging device 8. The through hole 411 on theinner rim of the storage bag body 1 is coupled to a hook element 42 having a substantially C-shaped opening. The hook element 42 is further coupled to a suspending plate 43 having a plurality of in-line spaced through holes 431. The rod fitting means 3 includes a hollow rod 31 and a fitting rod 32 having a C-shaped cross section. To seal the sealable opening 11 of the storage bag body 1, a suitable length of the sealable opening 11 is wrapped on the outer circumference of the hollow rod 31 for one round, and the fitting rod 32 is pressed over the hollow rod 31 fittingly to hold that length of the sealable opening 11 firmly on the circumference of the hollow rod 31. Referring to FIG. 2, the suction device 2 includes a seat 21, a press plate 22, a rotary cover 23 and a top cover 24. The seat 21 is coupled to the storage bag body 1 by hot fusion and has a projecting connecting portion 211 at its center. The connecting portion 211 has an inner wall provided with threads forming an internally threaded portion 212. The outer peripheral portion of the seat 21 is provided with radially spaced air vents 215, see FIG. 2A. Each air vent 215 has divider plates 214 of a certain height at lower outer edges thereof to prevent blockage by the articles 5 during air discharge and facilitate speedy discharge of air. The center of the connecting portion 211 is a through air hole 213 for entry and exit of air, the top outer edge thereof being provided with divider plates 214 as well. The press plate 22 resembles a disk having a central opening. The periphery of the central opening is provided a plurality of spaced bosses 221 for retaining and positioning the seat 21 after the central opening is fitted over the connecting portion 211. The rotary cover 23 has an annular raised opening 231 at the center of its upper side. The periphery of the inner wall of the raised opening 231 is provided with a plurality of air vents 232 while the center thereof forms a recess 233 for receiving an air stop 234 made of soft silicon rubber. A lower portion of the raised opening 231 extends downwardly to form an externally threaded portion 235 (see FIG. 5) that matches the threaded portion 212 of the connecting portion 211 of the seat 21. After articles 5 have been placed flatly inside the storage bag body 1 and the sealable opening 11 has been closed by rod fitting means 3, air inside the bag body 1 is drawn out by using a vacuum cleaner, and the air will escape from the air hole 213 and air vents 215 of the seat 21 in the direction as shown in FIG. 5A. When all the air inside the bag body 1 has been removed, the rotary cover 23 is tightened (as shown in FIG. 5B) so that the air stop 234 tightly stops the air hole 213 of the seat 21. The top cover 24 is then fitted over the raised opening 231 to prevent reverse flow of air into the bag body 1, thus achieving a vacuum state in the bag body 1.

Figure 4:
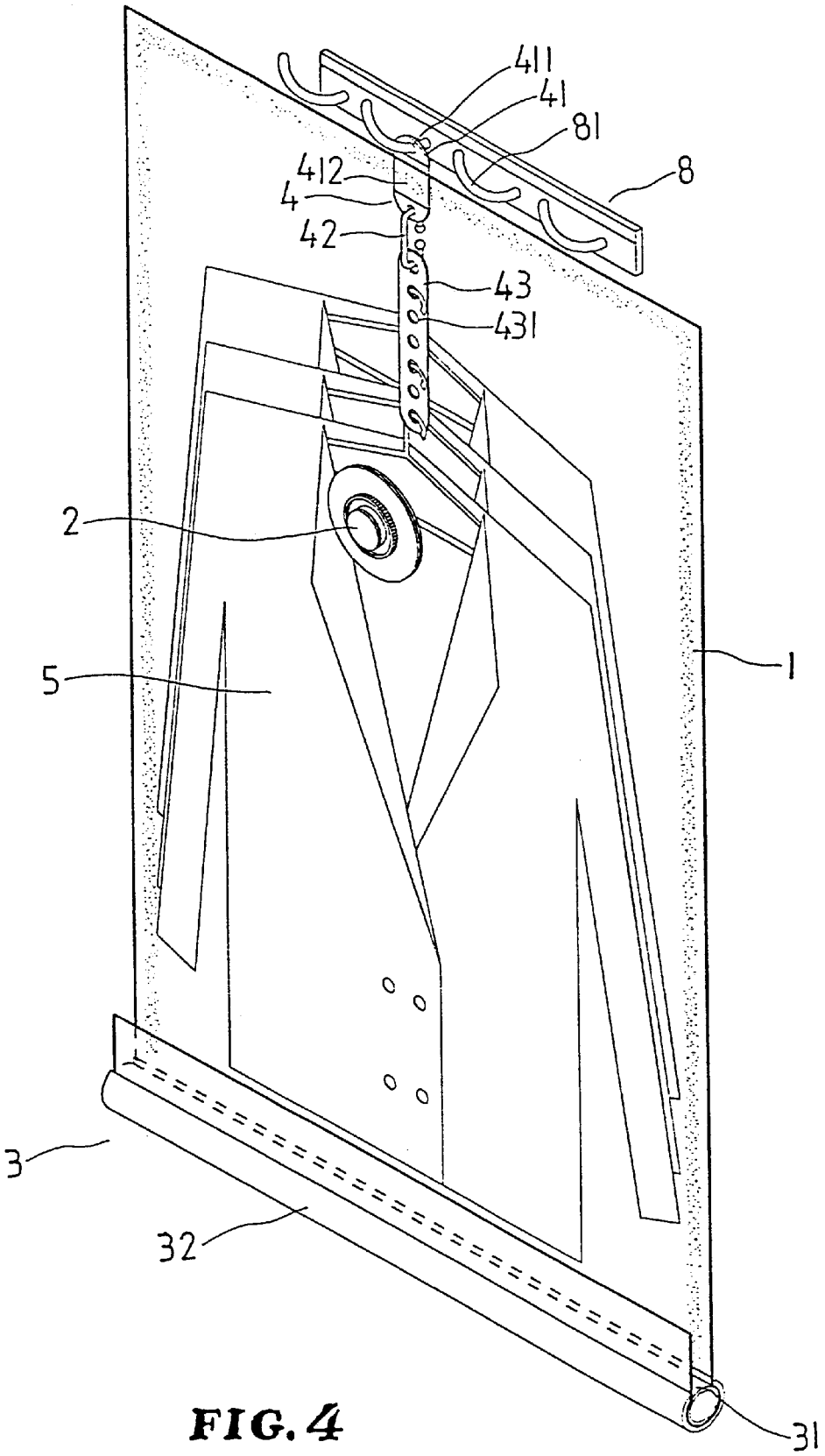
FIG. 4 is a schematic view of an embodiment of the present invention in use.

Referring to FIG. 4, the vacuum storage bag may be suspended on the hanging hook 8 of the clothes hanging device 8 by means of the through hole 411 on the suspending element 41 of the suspending device 4.

Figure 6:
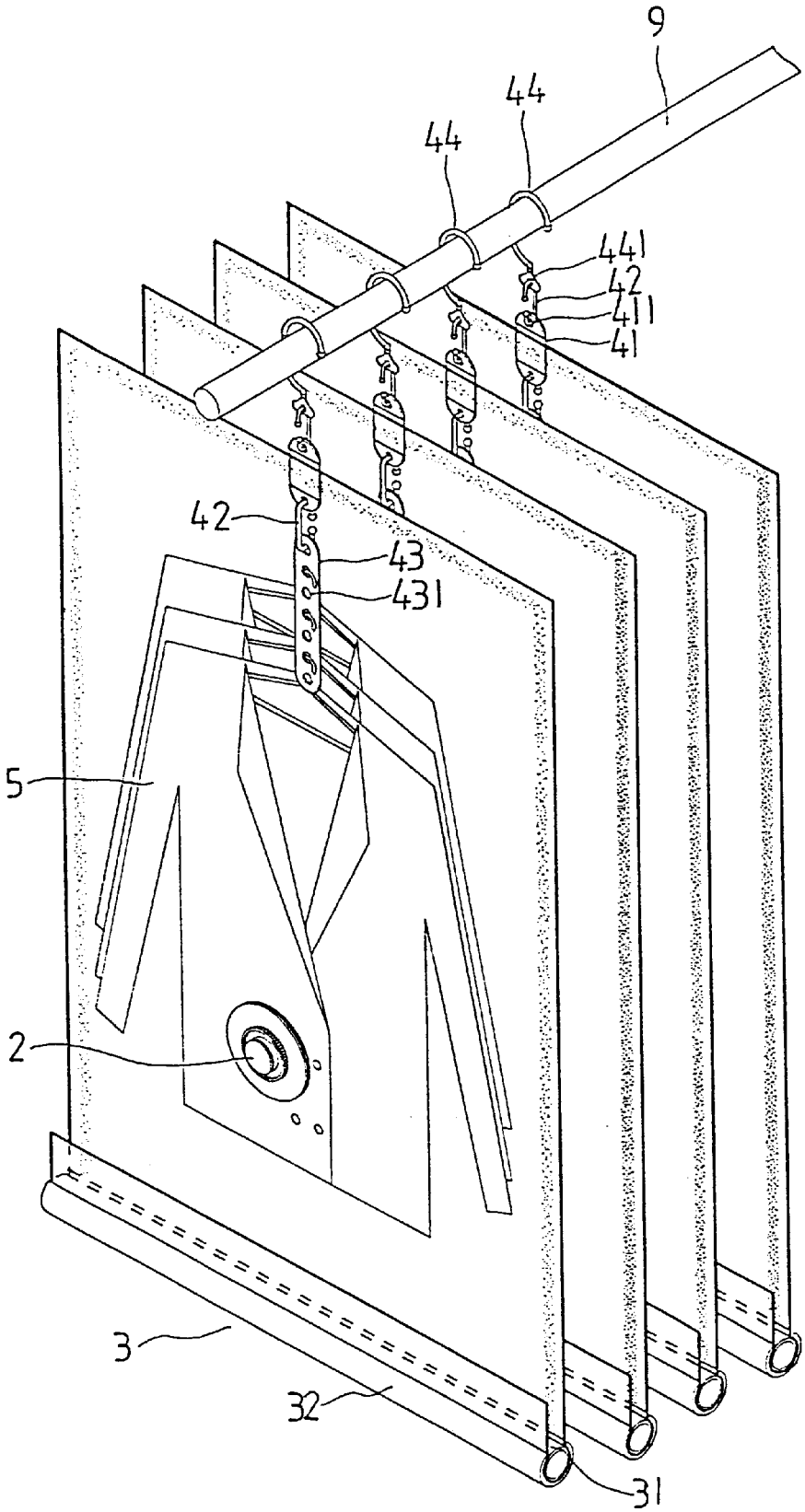
FIG. 6 is a schematic view of the present invention in use, in which the sealable opening of the bag body is sealed by using fitting rods and the suspending device includes a suspending element.

Referring to FIG. 6, the outer edge of the suspending element 41 of the suspending device 4 is further provided with a hook element 42 and a hanging hook 44. The hanging hook 44 has a relatively large curved opening and has one end thereof suspended on a clothes hanging rod 9 with the other end provided with a hook hole 441 for receiving one end of the hook element 42.

Figure 7:
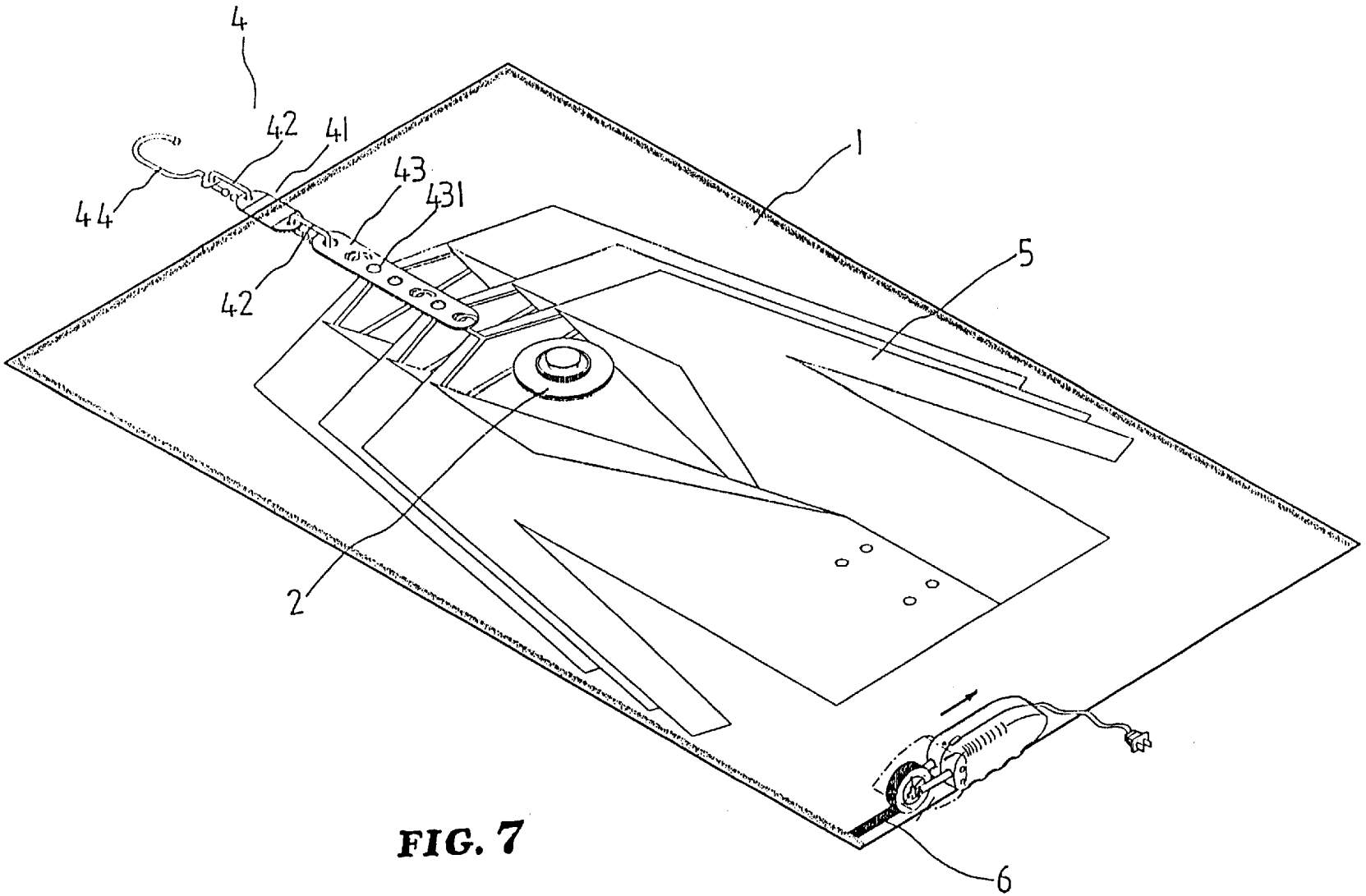
FIG. 7 is a schematic view of the present invention in use, in which the sealable opening of the bag body is sealed by using a hot press sealing machine.
Figure 8:
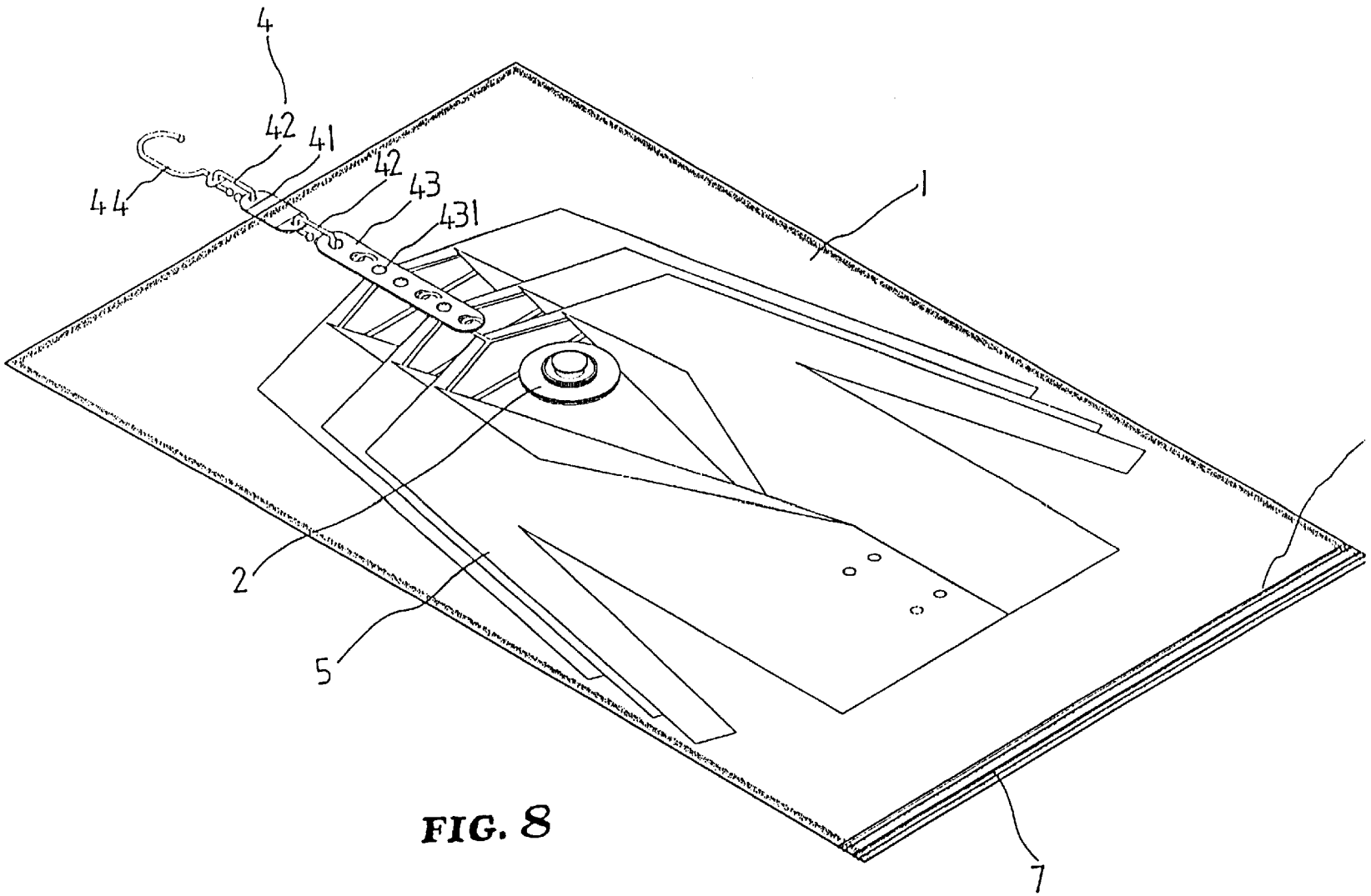
FIG. 8 is a schematic view of the present invention in use, in which the sealable opening of the bag body is sealed by male and female engaging means.

Referring to FIG. 7, the sealable opening 11 of the bag body 1 may also be sealed by hot press lines 6 using a hot press sealing machine. For the same reasons, the sealable opening 11 may also be sealed by male and female engaging means 7.

Figure 9:
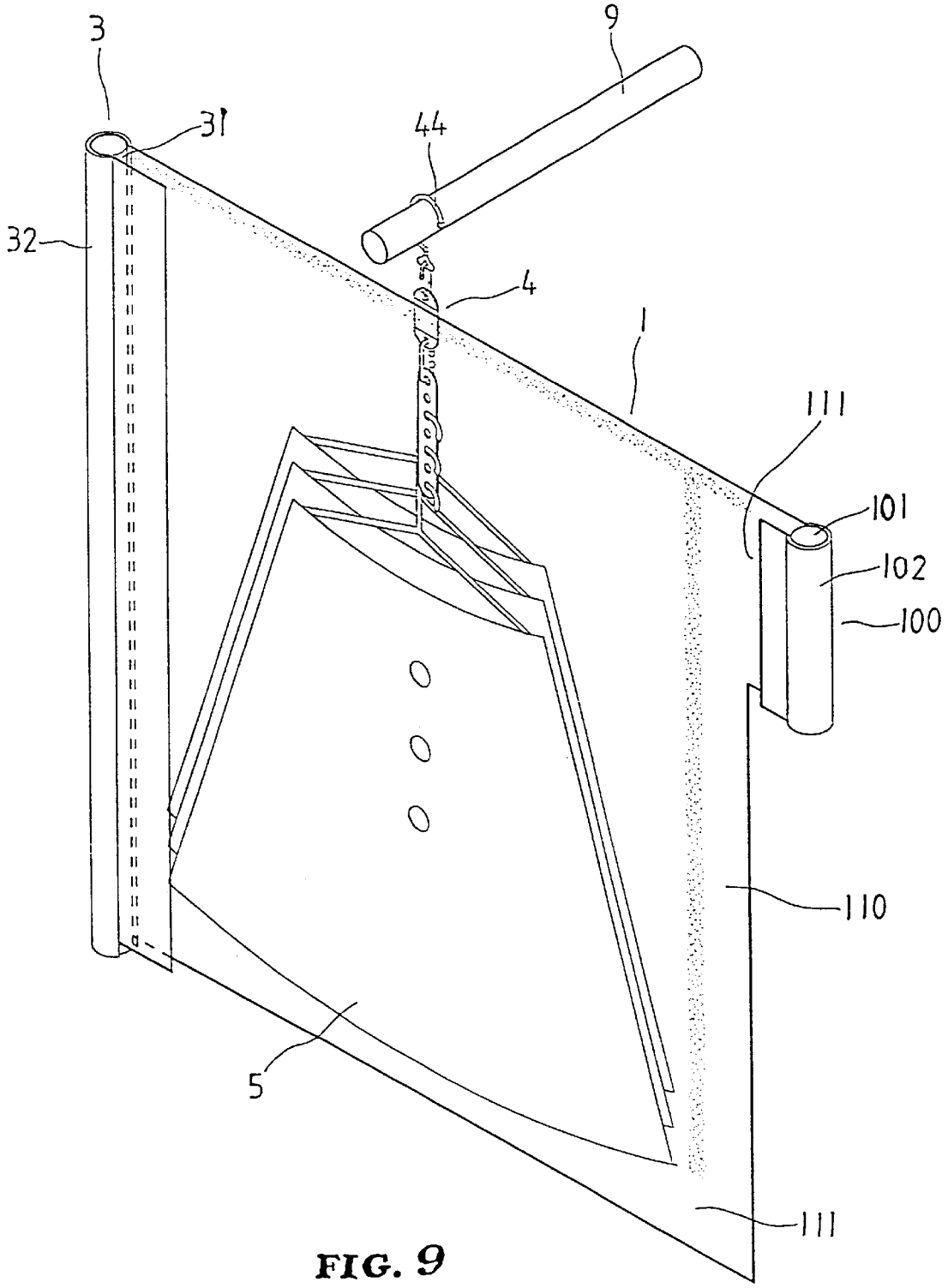
FIG. 9 is a schematic view of another embodiment of the present invention in which the bag body is provided with an S-shaped air channel and a sealable opening on an opposite side closed by fitting rods.
Figure 10:
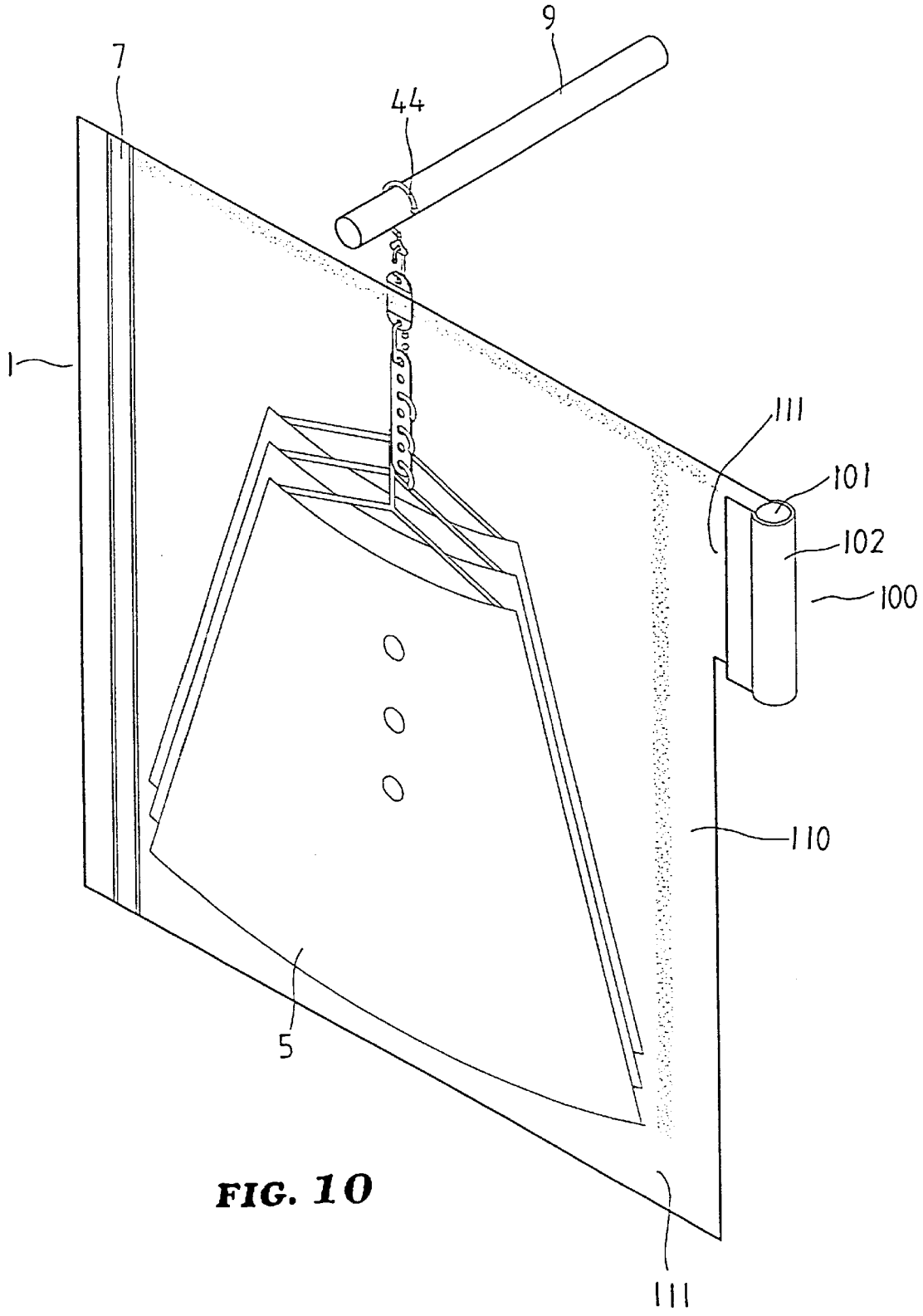
FIG. 10 is a schematic view of the embodiment shown in FIG. 9 in which the sealable opening is sealed by male and female engaging means.
Figure 11:
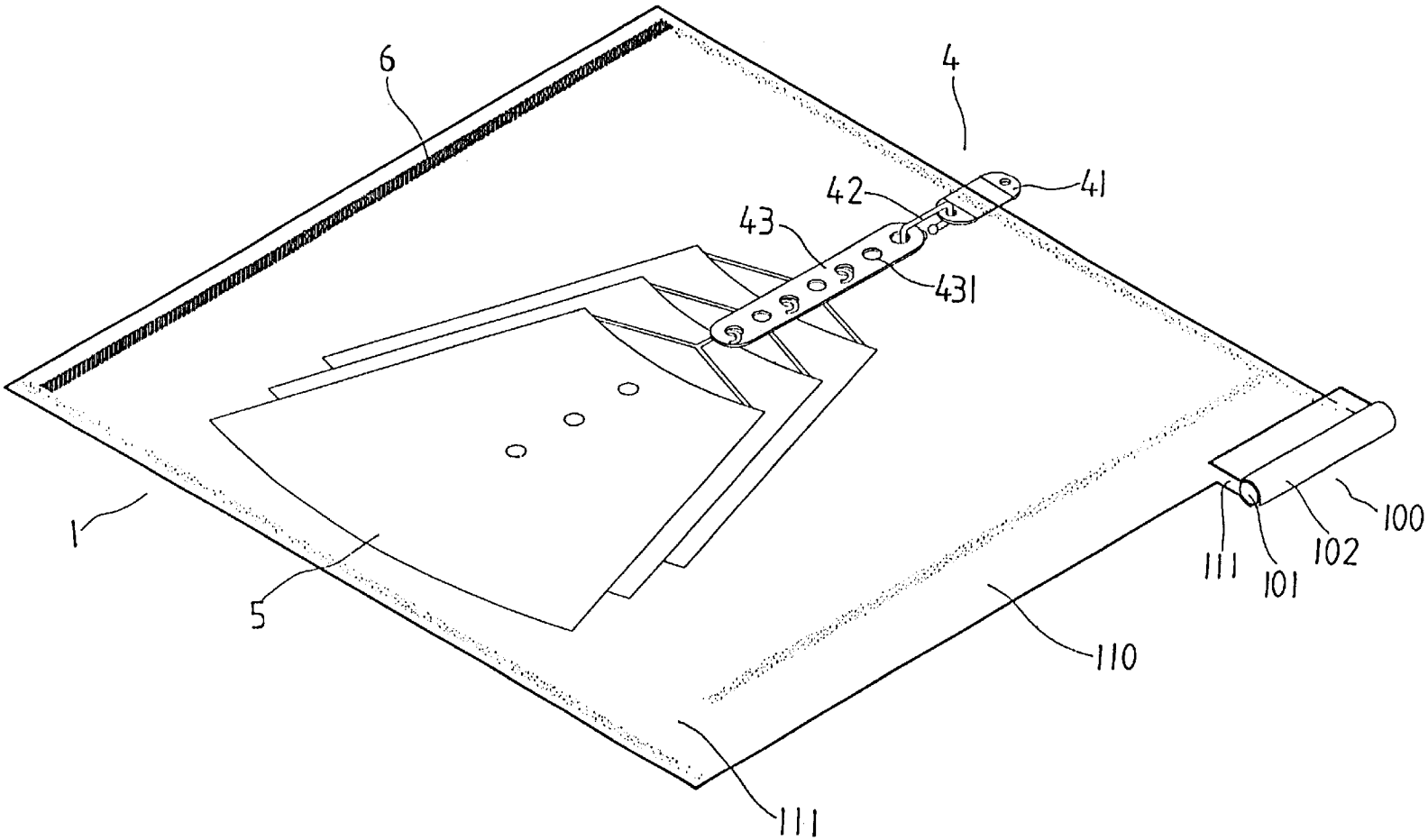
FIG. 11 is a schematic view of the embodiment shown in FIG. 9, in which the sealable opening is sealed by using hot press sealing machines.

Referring to FIG. 9, one side of the bag body 1 is configured to have an S- shaped portion having two air exits 111 at both ends and an air channel 110. The air exits 111 extend from the bag body 1 for a certain length. After the air has been totally extracted, the S-shaped portion is closed by using a rod fitting means 100 including a rod 111 and a fitting rod 102 of a C-shaped cross section. The sealable opening 11 of the bag body may also be closed by rod fitting means 3, male and female engaging means 7 (as shown in FIG. 10) or hot press lines 6 (as shown in FIG. 11). The suspending device 4 may then be provided on one of the remaining two sides at the center and may include a suspending element 41 or hook element 41 and hanging hook 44 depending on the environment in which the storage bag is used.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A suspendable vacuum storage bag, comprising:

a storage bag body adapted to receive articles flatly placed therein, said storage bag body having a single opening forming a sealable opening that is sealable by a sealing means, a suction device provided on a wide side of said storage bag body at a suitable position for complete discharge of air inside said storage bag body; and a suspending device that includes a suspending element, a hook element and a suspending plate, said suspending element being provided at a suitable edge of said storage bag body and including a plate body having an intermediate portion of a smaller thickness and two side portions of a larger thickness, said side portions being formed with respective through holes, one of said through holes being located at an outer end, the other thereof being located inside said storage bag body, said hook element having a C-shaped opening and being fastened to said through hole of said suspending element inside said storage bag, said suspending plate being provided with a plurality of in-line through holes for receiving said hook element, whereby a plurality of articles may be neatly hung on said suspending plate, and said through hole at the outer end of said suspending element is suspended on a hanging hook of a clothes hanging device, thus achieving optimum use of available storage space.

2. The suspendable vacuum storage bag as claimed in claim 1, wherein said suspending device may be provided at an end opposite or adjacent to aid sealable opening.

3. The suspendable vacuum storage bag as claimed in claim 1, wherein said suspending device further includes a hook element and a hanging hook, said hook element having a C-shaped opening and fastenable to said through hole at the outer end of said suspending element, said hanging hook having a hooking portion with a large curved opening at one end and a hook hole at the other for receiving said hook element, whereby said storage bag body may be suspended on a clothes hanging rod or in a wardrobe.

4. The suspendable vacuum storage bag as claimed in claim 1, wherein said sealing means includes a hollow rod and a fitting rod having a C-shaped cross section for engaging fittingly and tightly said hollow rod.

5. The suspendable vacuum storage bag as claimed in claim 1, wherein said sealing means are hot press lines formed using hot fusion.

6. The suspendable vacuum storage bag as claimed in claim 1, wherein said sealing means are male and female engaging means.

7. The suspendable vacuum storage bag as claimed in claim 1, wherein said suction device includes a seat that is essentially a stepped disk structure coupled to said storage bag body tightly and sealingly, said seat being centrally provided with a projecting connecting portion having an inner wall provided with threads forming an internally threaded portion, said seat further having a plurality of radially spaced air vents on a peripheral surface thereof, each of said air vents being provided with divider plates at lower outer edges thereof of a certain height, said connecting portion having a central through air hole that is likewise provided with divider plates at a upper outer edge thereof; a press plate that is a disk structure having a central opening, said central opening having an inner wall provided with a plurality of spaced bosses for retaining and positioning said connecting portion of said seat when said central opening is fitted over said connected portion; a rotary cover having an annular raised opening provided centrally of an upper side thereof, said raised opening having an inner wall provided with a plurality of air vents and defining a recess at the center for receiving an air stop made of soft silicon rubber, a lower portion of said raised opening extending downwardly to form an externally threaded portion that matches said externally threaded portion of said connecting portion of said seat and a top cover for engaging said raised opening of said rotary cover.

8. A suspendable vacuum storage bag, comprising:

a storage bag body adapted to receive articles flatly placed therein, said storage bag body having a single opening at a narrow side forming a sealable opening, and a S-shaped air channel having two air exits at an opposite side, said sealable opening can be sealed by a sealing means, said air exits extending from said storage bag body for a certain length and sealable by a sealing means after extraction of air from said storage bag body; and a suspending device that includes a suspending element, a hook element and a suspending plate, said suspending element being provided at a suitable edge of said storage bag body and including a plate body having an intermediate portion of a smaller thickness and two side portions of a larger thickness, said side portions being formed with respective through holes, one of said through holes being located at an outer end, the other thereof being located inside said storage bag body, said hook element having a C-shaped opening and being fastened to said through hole of said suspending element inside said storage bag, said suspending plate being provided with a plurality of in-line through holes for receiving said hook element;

whereby a plurality of articles may be neatly hung on said suspending plate, and said through hole at the outer end of said suspending element is suspended on a hanging hook of a clothes hanging device, thus achieving optimum use of available storage space.

* * * * *